US006095026A

United States Patent [19]

Poussard et al.

[11] Patent Number: 6,095,026

[45] Date of Patent: Aug. 1, 2000

[54] SYSTEM FOR THE LOADING OF A MORTAR

[75] Inventors: Jean-Marie Poussard, La Ferte St Aubin; Bruno Boissiere, Olivet; Pascal Herrero, Clery St Andre; Pascal Rondet, Orleans, all of France

[73] Assignee: TDA Armements S.A.S., La Ferte St Aubin, France

[21] Appl. No.: 09/111,795

[22] Filed: Jul. 8, 1998

[30] Foreign Application Priority Data

Jul. 11, 1997 [FR] France ..... 97 08877

[51] Int. Cl.[7] ..... F41A 9/13

[52] U.S. Cl. ..... 89/46; 89/1.3; 89/37.05

[58] Field of Search ..... 89/45, 46, 1.3, 89/37.05, 40.02, 1.35; 42/51

[56] References Cited

U.S. PATENT DOCUMENTS

| | | | |
|---|---|---|---|
| 1,158,161 | 10/1915 | Bean et al. | 89/46 |
| 1,364,009 | 12/1920 | Thorleipson | 42/105 |
| 2,922,338 | 1/1960 | Barbe | 89/1.3 |
| 3,818,794 | 6/1974 | Mayer et al. | 89/40.03 |
| 4,011,794 | 3/1977 | Leshem | 89/47 |
| 4,198,897 | 4/1980 | Lipp et al. | 89/13.05 |
| 4,619,181 | 10/1986 | Pehker et al. | 89/34 |
| 4,669,357 | 6/1987 | Von Laar et al. | 89/40.02 |
| 4,974,491 | 12/1990 | Von Laar et al. | 89/37.05 |
| 5,050,479 | 9/1991 | Heintz et al. | 89/46 |
| 5,337,672 | 8/1994 | Boissiere et al. | 102/481 |
| 5,347,911 | 9/1994 | Hallqvist | 89/45 |

FOREIGN PATENT DOCUMENTS

| | | |
|---|---|---|
| 2 647 888 | 12/1990 | France . |
| 2 169 389 | 9/1986 | United Kingdom . |

*Primary Examiner*—Stephen M. Johnson
*Attorney, Agent, or Firm*—Oblon, Spivak, McClelland, Maier & Neustadt, P.C.

[57] ABSTRACT

An ammunition magazine mounted directly on a mortar to improve the firing rate of the mortar. The rounds of ammunition contained in the magazine are conveyed to a predetermined position through the use of a motor drive where they are taken by a transfer device that extracts them from the magazine and places them into the barrel of the mortar.

4 Claims, 10 Drawing Sheets

PRIOR ART

SYSTEM FOR THE LOADING OF A MORTAR

BACKGROUND OF THE INVENTION

The present invention relates to mortars and more particularly to their loading.

A known way of loading muzzle-loading mortars uses transfer means fixedly joined to the barrel of the mortar which, when a round of ammunition is positioned at a place designed for this purpose, transfers it to the top of the barrel and then, after having placed it in the extension of the barrel, introduces it into the muzzle of the barrel.

This method of operation improves the loading process in terms of both ease and speed of operation as compared with the conventional method of manual loading. However, the positioning of the ammunition is a difficult task and slows down the firing rate.

SUMMARY OF THE INVENTION

The aim of the present invention is to prevent or at least to reduce this drawback.

This is obtained by providing the mortar, in addition to the transfer means indicated here above, with an ammunition magazine that is directly mounted on the mortar and is capable of providing rounds of ammunition one by one to the transfer means.

According to the present invention, there is provided a system for the loading of a mortar having, firstly, a barrel with an interior and a muzzle and, secondly, a bottom part, the mortar being a muzzle-loading mortar, the system comprising an ammunition magazine provided with rounds of ammunition and transfer means, the magazine being fitted into the mortar in its bottom part and being provided with a driving device to convey the rounds of ammunition one by one to a predetermined location and the transfer means being mounted on the barrel of the mortar to transfer the rounds of ammunition one by one from the bottom part of the mortar to the interior of the barrel of the mortar, these transfer means comprising hooking means to take the rounds of ammunition one by one from the magazine to the predetermined position.

BRIEF DESCRIPTION OF THE DRAWINGS

The present invention will be understood more clearly and other features shall appear from the following description and from the appended drawings, of which.

In the different figures, the corresponding elements are designated by the same references.

DETAILED DESCRIPTION OF THE PREFERRED EMBODIMENTS

Figure 1:
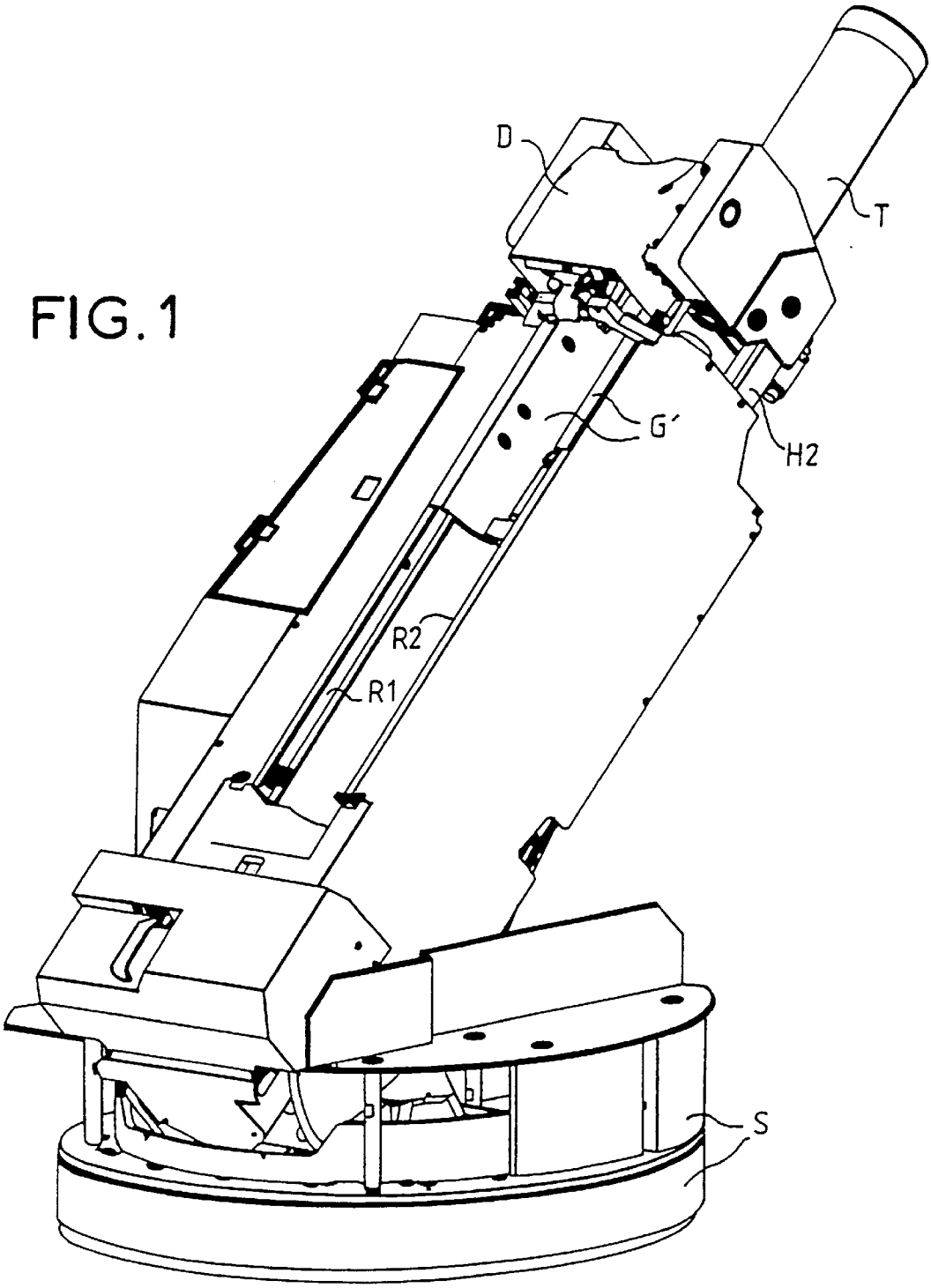
FIG. 1 shows a prior art mortar.

FIG. 1 shows a prior art mortar with its rotary pedestal S, its inclinable barrel T and its different accessories including ammunition transfer means comprising a trough G' that is mobile on rails R1, R2 and a device D constituting a hinged double parallelogram and clamps mounted on two slides, of which only one, H2, can be seen in the figure. In FIG. 1, the trough G' is shown in the top position.

Figure 2:
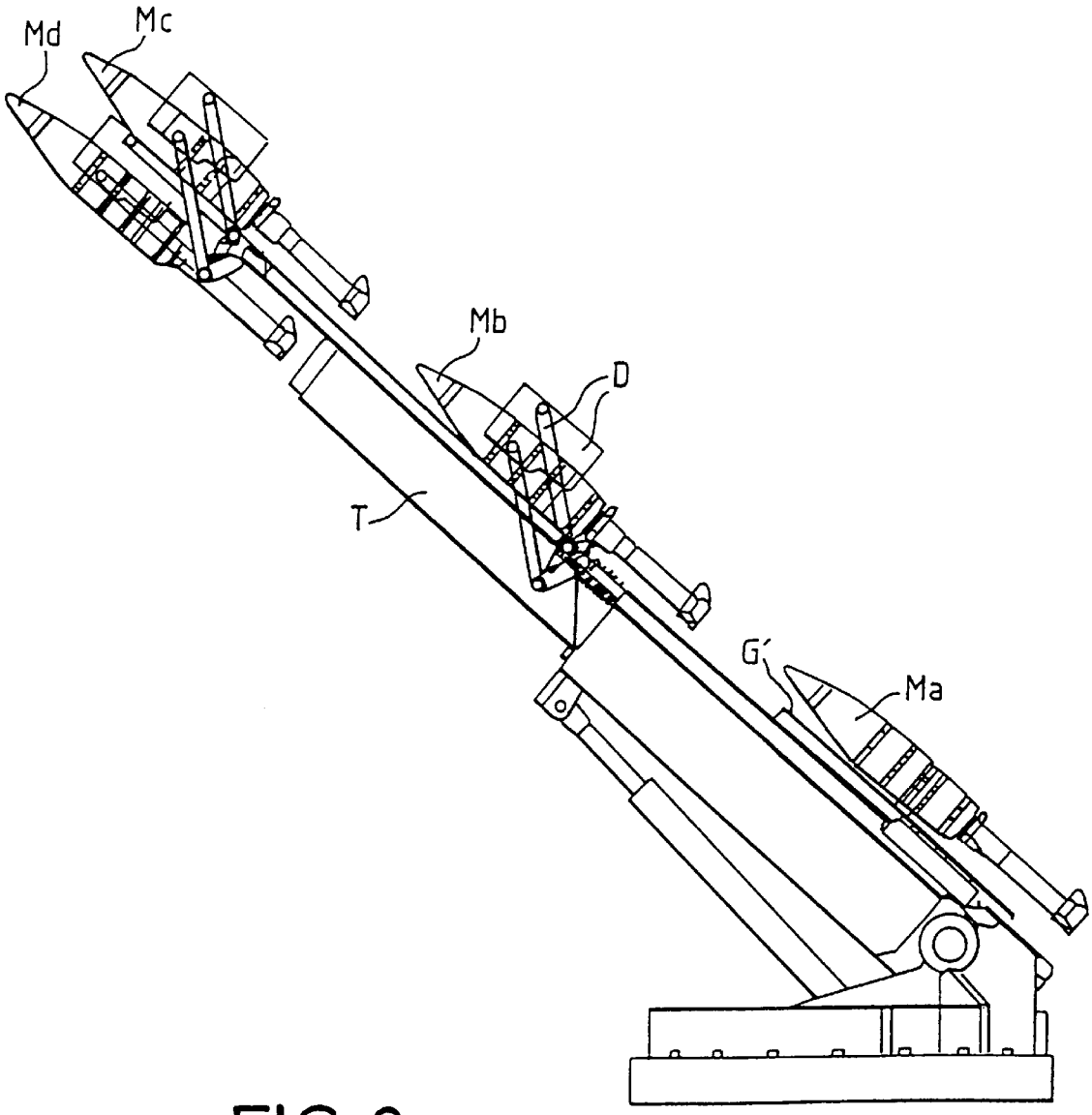
FIG. 2 PRIOR ART
FIG. 2 is a drawing showing the successive steps of the loading process with a mortar like that of FIG. 1.

FIG. 2 is a schematic view showing the mortar of FIG. 1 stripped of its sheet-metal cladding. In this figure, a round of ammunition M is shown four times:

firstly, it is shown in a position Ma which is the position occupied by the ammunition when it is deposited in the trough G' which is seen in a sectional view;

secondly, it is shown in a position Mb where, with the trough having reached the top position by a motion of translation parallel to the barrel of the mortar and the device D with hinged double-parallelogram and clamps being in the low position, the ammunition is held between the clamps of the device, thirdly, it is shown in a position Mc where the device D is in the top position but where the double parallelogram has not been actuated, fourthly, it is shown in a position Md where the double parallelogram has been actuated, shifting the ammunition to place it in the extension of the barrel T, close to the muzzle of the mortar.

The loading process takes place with the passage of the ammunition successively in the positions Ma, Mb, Mc and Md and then, without modifying the position of the double-parallelogram, the device D recoils on its slide. The ammunition thus penetrates the muzzle of the mortar and when it has penetrated to a sufficient degree, the clamps open and the ammunition slips by itself into the bottom of the barrel T.

It must be noted that so long as the ammunition M lies in the trough G', it is held laterally by the edges of the trough G' and is prevented from sliding backwards by a stop Gb on which there rests a rifled ring forming a protuberance, Mo, proper to the ammunition used, takes support. These four elements can be seen in the schematic sectional view of FIG. 3. This view also shows a thruster P that drives the trough G' in the above-mentioned translation motion parallel to the barrel.

It must be noted that since the ammunition described is rifled ammunition designed for a rifled barrel, it must be positioned with precision. For this purpose, at the position provided for the protruberance Mo, the trough G comprises a metal finger that is placed between two rifling grooves of the protruberance when a round of ammunition is placed in the trough.

Figure 4:
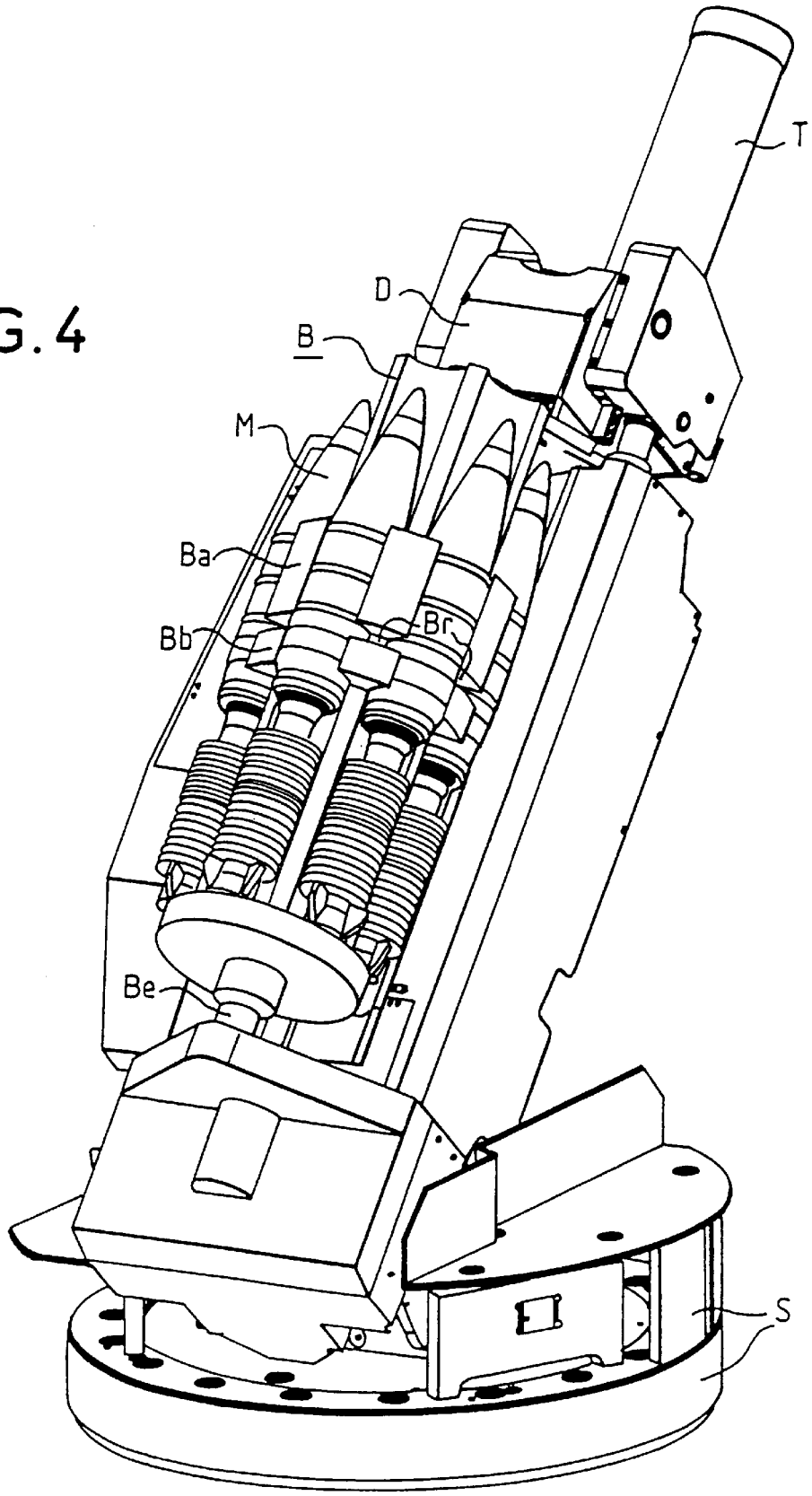
Figure 5:
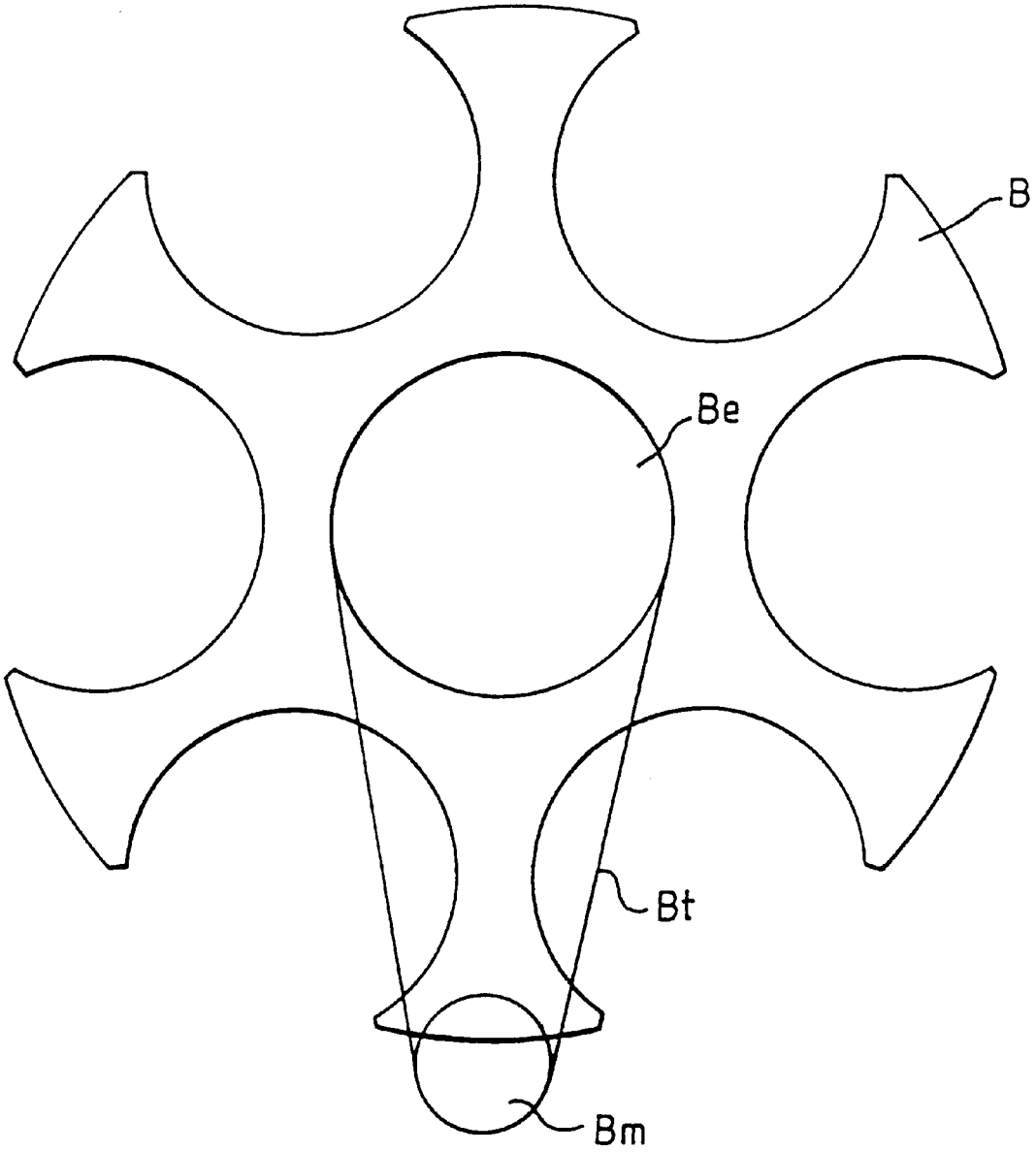
FIGS. 5, 8 and 9 are partial schematic views of the mortar of FIG. 4.

FIG. 4 shows a mortar according to the invention. This is a mortar of the type shown in FIG. 1 but, in its bottom part, has a magazine for six rounds of ammunition, and the magazine is constituted by a cylinder B. This cylinder is distinguished from the cylinder of a revolver by its shape, operation and function. It is distinguished by its shape because, laterally, it does not fully surround the ammunition but allows it to go beyond on its periphery. For this purpose, this chamber has six open housings as can be seen from the sectional view shown schematically in FIG. 5. It is distinguished by its operation because, while it does rotate about a shaft Be, this shaft is driven by a shaft motor Bm to which it is coupled by a chain drive Bt. The motor and the chain can be seen in FIG. 5. The cylinder is distinguished from that of a revolver by its function because it is designed to deposit its rounds of ammunition one by one at a position of the mortar corresponding to the position Ma according to FIG. 2 and then the ammunition thus deposited moves away from the position Ma and therefore from the cylinder in an upward motion and is then introduced into the muzzle of the mortar as described by means of FIG. 2. The cylinder therefore does not surround the ammunition when the latter is fired.

It must be seen in FIG. 4 that, in fact, the ammunition placed in the cylinder is not surrounded on more than 180 degrees and is therefore held laterally, on only about one-third of its length, through protruberances such as Ba, Bb separated by a transversal rifling Br whose role will be specified further below. It must furthermore be noted that the section along FIG. 5 has been made at these protruberances.

Figure 6:
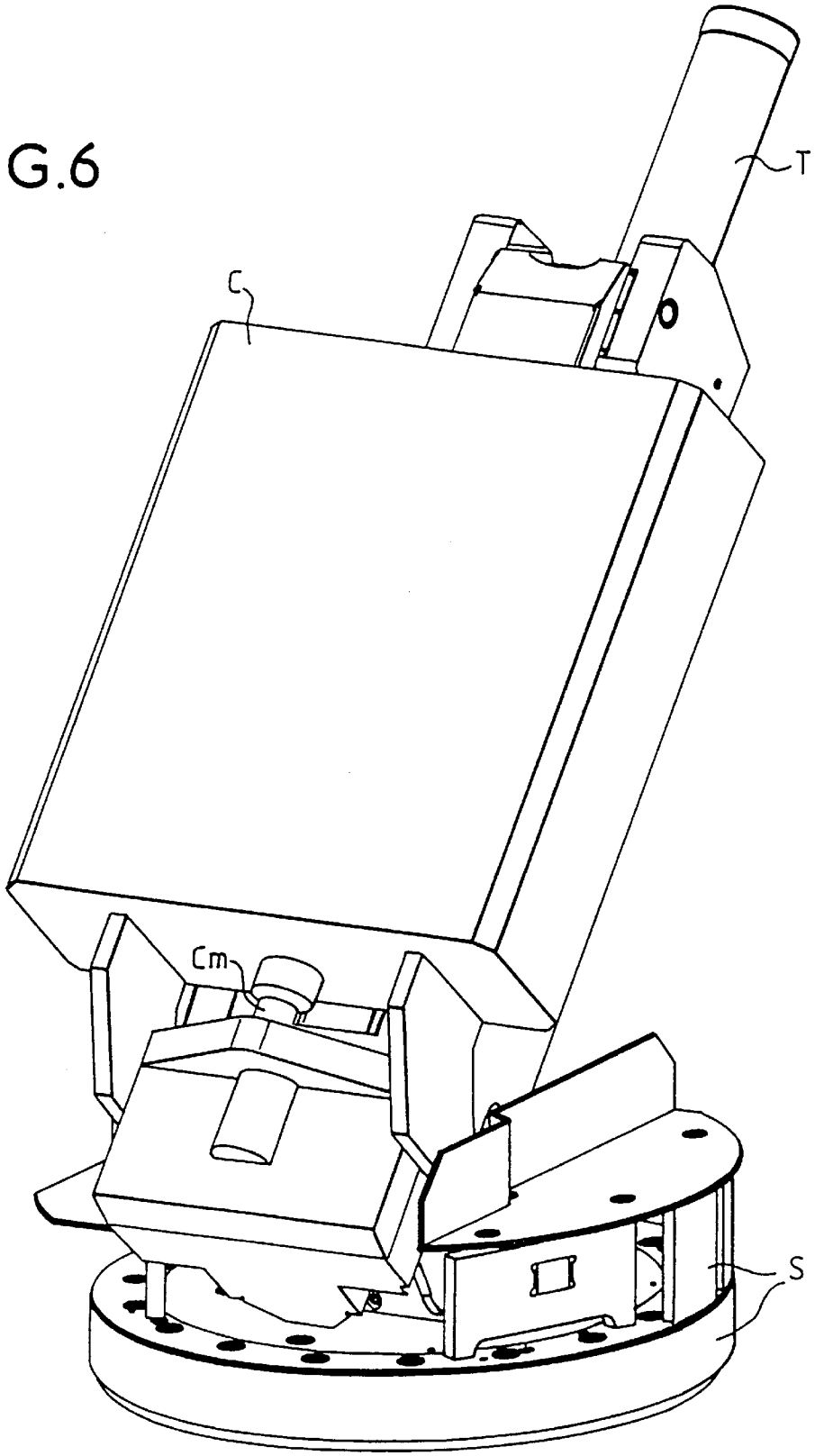

FIG. 6 shows another mortar according to the invention. Here again this is a mortar of the type shown in FIG. 1 but is provided, in its bottom part, with a magazine for six rounds of ammunition, and this magazine is constituted by a loader C. This loader is seen in a schematic cross-section view in FIG. 7. It is distinguished from a gun loader or pistol loader by troughs Cg1 . . . Cg10 which encase the ammunition in the same way as the housings of the cylinder according to FIGS. 4 and 5. It can be distinguished from them also by a system for driving the troughs using a shaft motor Cm that makes a shaft Ca rotate by means of a first chain drive Ct1. The mechanical shaft Ca is fixedly joined to a first wheel Cr1 with an axis parallel to that of a second wheel Cr2. A second chain drive Ct2 stretched between the two wheels and supported on them drives the troughs Cg1 . . . Cg10.

Figure 8:
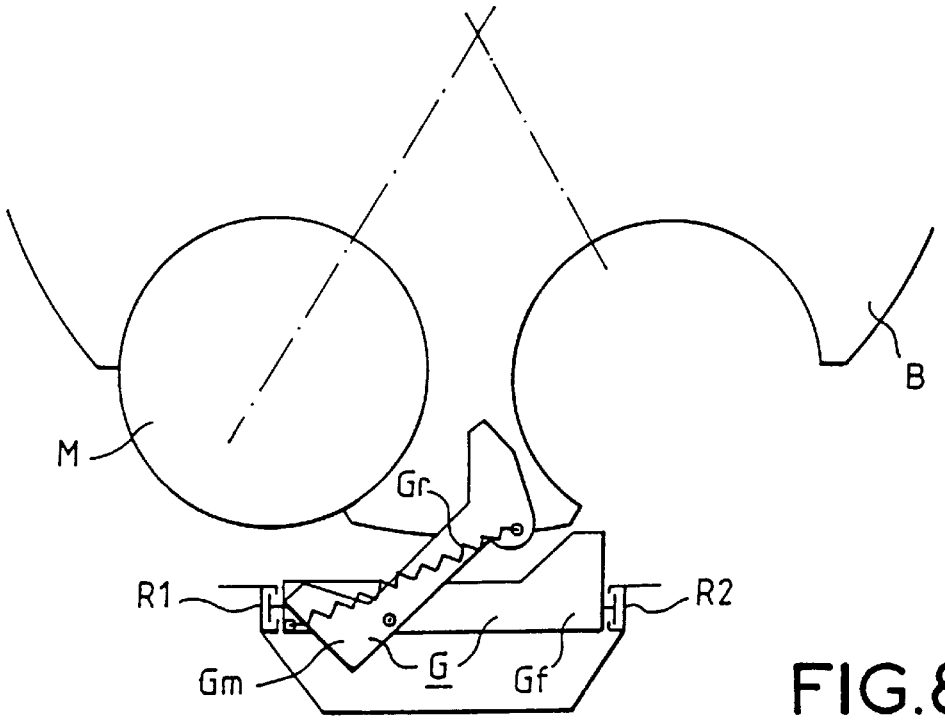
Figure 9:
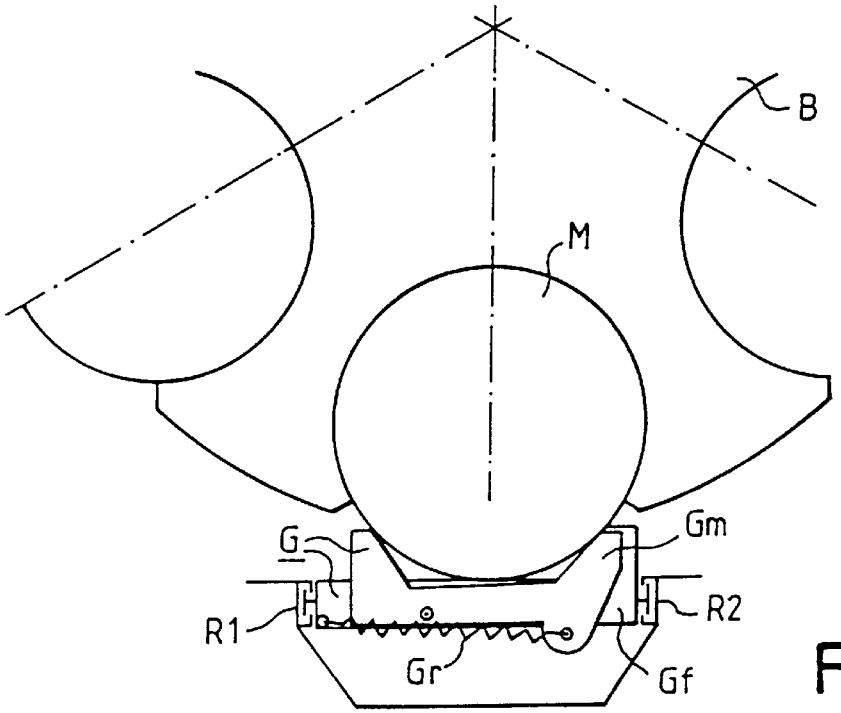

FIGS. 8 and 9 are sectional schematic views showing how, in the mortar according to FIG. 4, a ammunition M is transferred from the cylinder B to a trough G. This trough G, from the viewpoint of its position in the mortar and from the viewpoint of its function of transferring a round of ammunition in parallel to the barrel of the mortar, corresponds precisely to the trough G' of the mortar according to FIG. 1. By contrast, while the trough G' was formed as a single element, the trough G is hinged. It has a part Gf fixedly joined to the rails R1, R2 that correspond to the rails R1, R2 of FIG. 1 and a part Gm coupled to the part Gf to constitute a hinge that is bistable and therefore capable of taking two stable positions of equilibrium. The part Gf corresponds to a trough deprived of one of its two side edges so that, as can be seen in FIG. 8, it enables the ammunition to arrive in the trough. The part Gm is there to make up for the absence of a lateral edge by playing the role of a bolt which, in association with the rest of the trough, prevents lateral shifts of ammunition. In a conventional way, the bistable hinge comprises a spring Gr that is stretched between two points. One of these points, at the far end of the spring, is fixedly joined to the fixed part Gf while the other point is fixedly joined to the mobile part. A tilting axis parallel to the rails R1, R2 completes this bistable hinge. It enables the part Gm to pivot about the part Gf and is located in the surface swept by the spring Gr during the passage of the hinge from one stable position to the other.

The two stable positions of the hinge are respectively shown in FIGS. 8 and 9: these are the position pending the arrival of the ammunition M in FIG. 8 and, after a tilt due to the arrival of the ammunition M against the part Gm of the trough, a locking position shown in FIG. 9.

Figure 3:
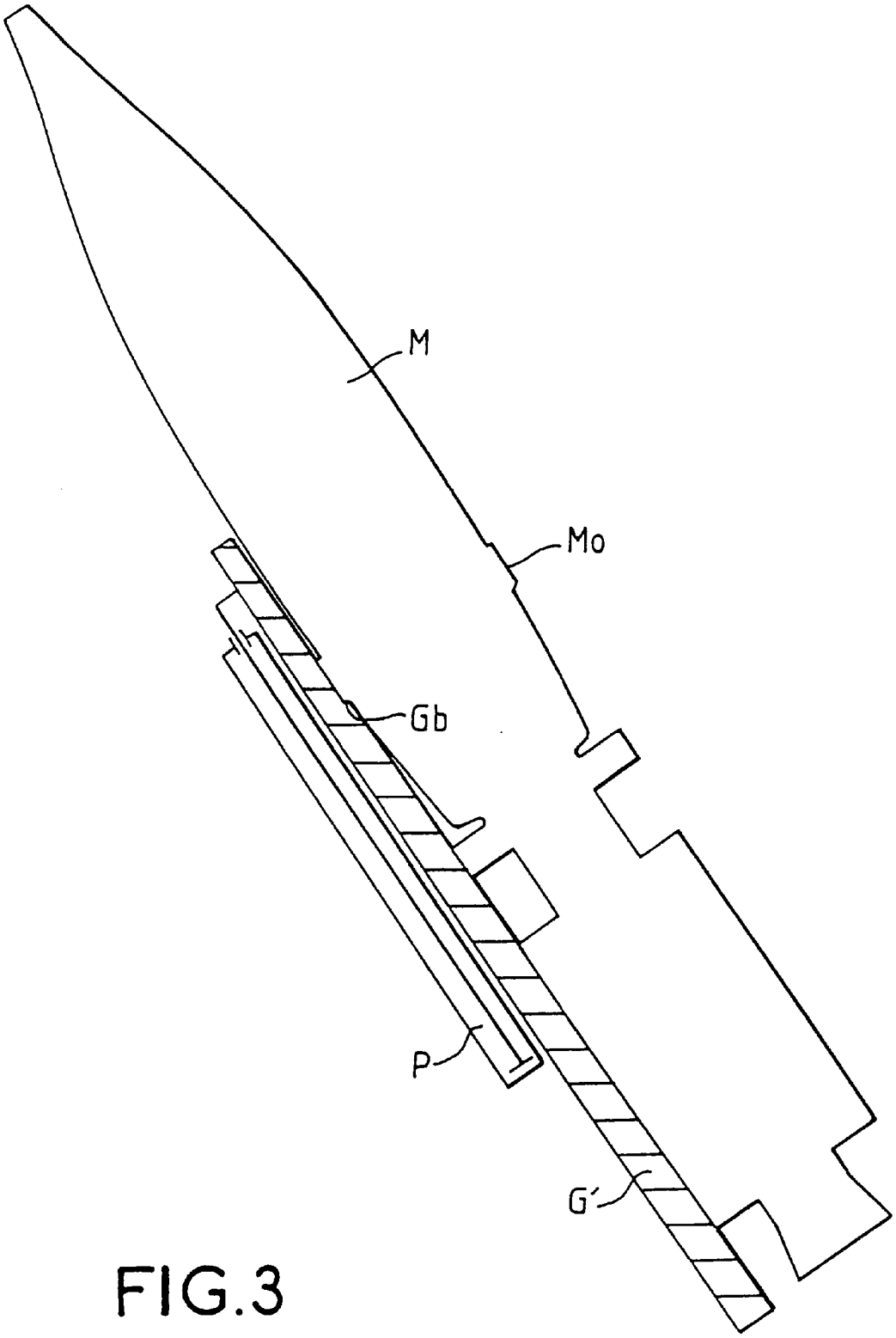
FIG.3 PRIOR ART
FIG. 3 is a partial schematic view of the mortar according to FIG. 1, FIGS. 4 and 6 show mortars according to the invention.
Figure 10:
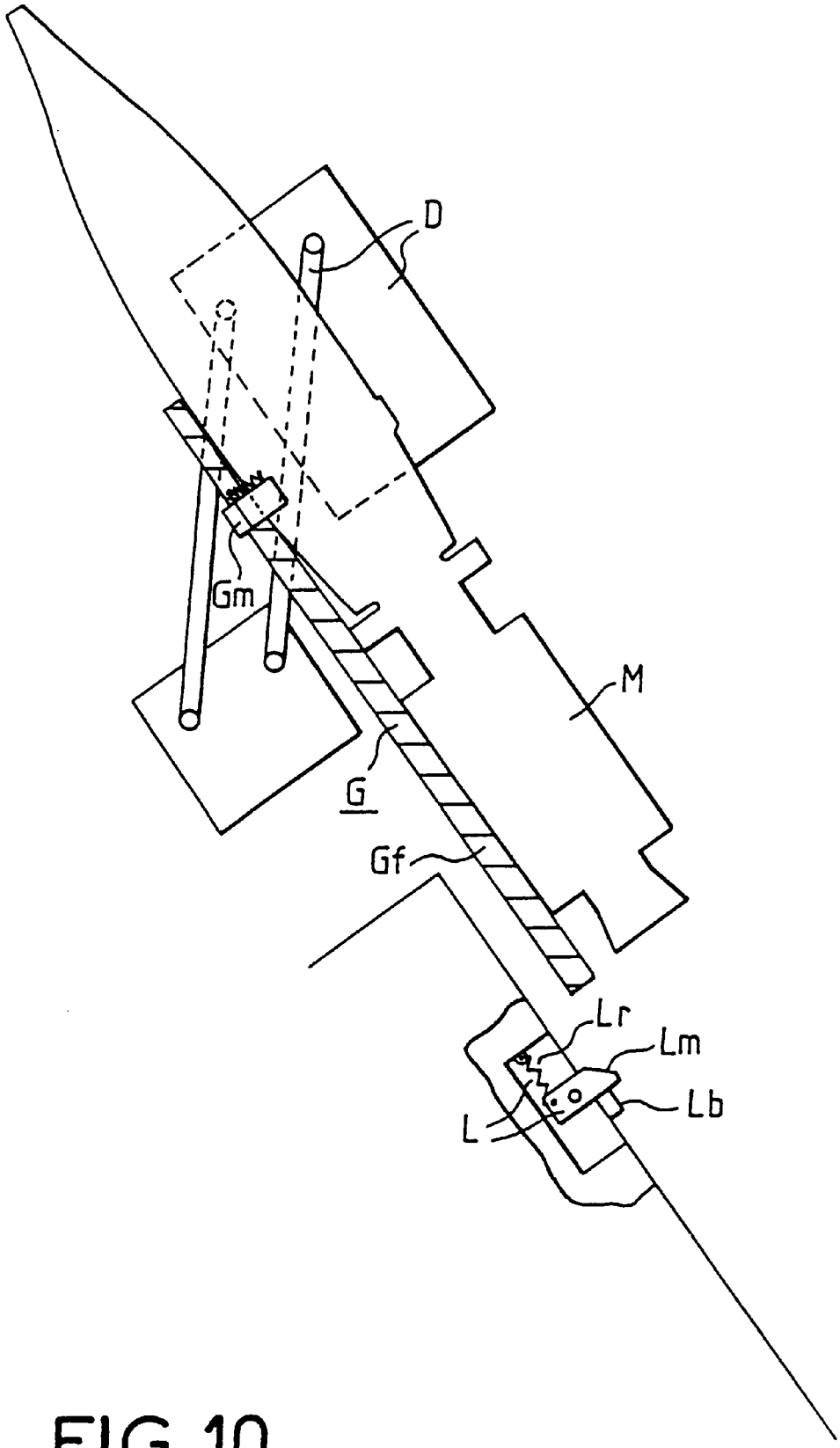

FIG. 10, as compared with FIG. 3, shows the modifications made to the ammunition transfer means to adapt them to operation with a cylinder or loader.

In FIG. 10, the ammunition M is mounted in a position that would be intermediate between the positions Ma and Mb according to FIG. 2 and corresponds to the time when the double-parallelogram device D comes and grasps it on the trough. The ammunition M is still held laterally in the trough G with the bolt Gf in the position of FIG. 9. Now it must be noted that, in its motion of upward translation to reach the place at which it is situated in FIG. 10, the assembly constituting the trough and the ammunition has gone above a latch L fixed to the barrel. This latch has a part Lm pivoting about a horizontal axis perpendicular to the direction of translation of the ammunition, a stop Lb located just before the pivoting part and a spring Lr hooked at one end to the barrel and, at the other end, to the pivoting part. The three elements Lm, Lb, Lr of the latch L are arranged so that the part Lm struck by the lower part of the bolt Gm during the upward translation of the ammunition M, gets depressed and then returns against the stop Lb. However, when the trough G returns backwards to find another round of ammunition, the part Lm cannot get depressed for it is blocked by the stop Lb. Now, at the place where it is struck in the downward motion by the bolt Gm, the part Lm has an inclined part that obliges the bolt to rise and go to the pending position as shown in solid lines in FIG. 11.

Although it is placed in a pending position, the bolt Gm, during the downward motion, can get inserted into the cylinder until it is placed at the rifling groove Br described with reference to FIG. 4. It takes advantage for this purpose of the space left free in the cylinder by the ammunition that has just been translated towards the top of the mortar.

Figure 11:
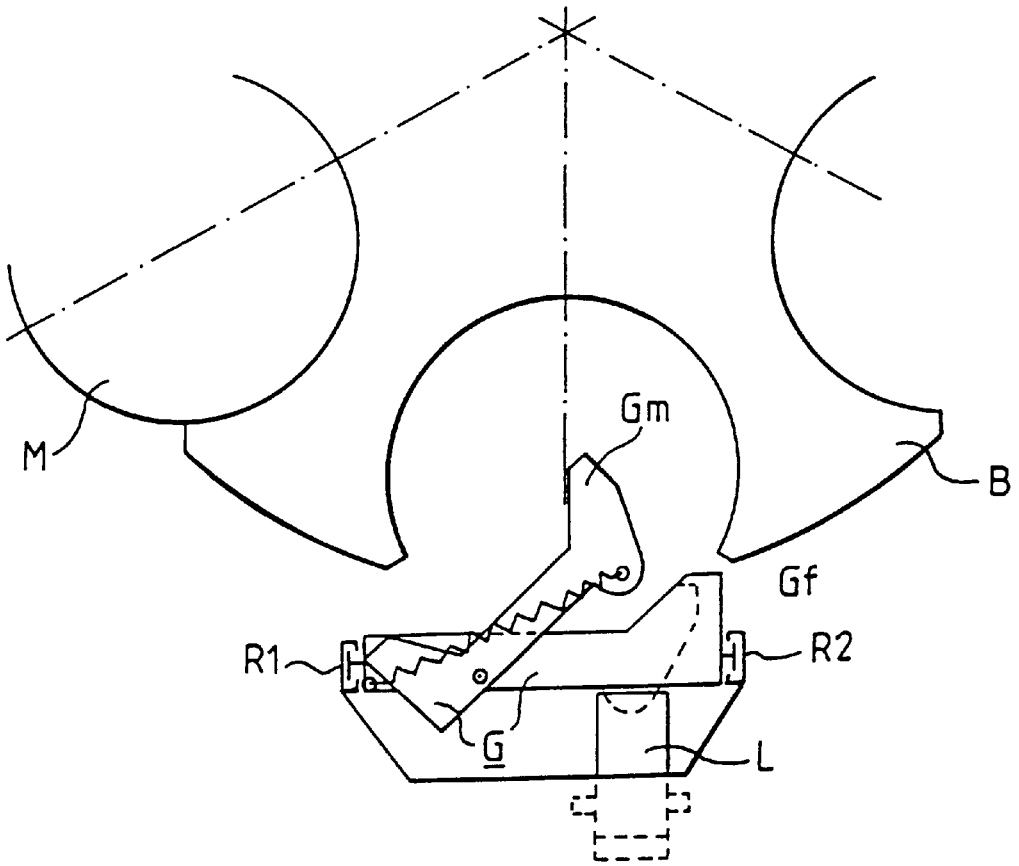

And as soon as the bolt placed in the pending position reaches the rifling groove Br, as described with reference to FIG. 4, the cylinder can rotate to bring a fresh round of ammunition to the trough G. The sequence of these operations is illustrated by FIGS. 11 and then 8 and 9. It must be noted on this subject that in the example described, the rotation of the cylinder, as seen from the bottom, takes place in an anticlockwise direction.

With reference to FIGS. 8, 9 and 11, it must be specified that what is shown is what will be seen by an observer of the cylinder and of the trough if the part of the cylinder above the rifling groove Br were to be removed and if the bolt Gm were to be at the level of the rifling groove. It must be furthermore be noted that, in FIG. 11, the latch L has been shown and the part of the bolt Gm that has just struck the latch has been drawn in dashes in the position where it strikes the latch, namely in the locking position.

As for the loading of the cylinder, it is done with the double-parallelogram device D in a position similar to the one corresponding to the ammunition Mb in FIG. 2 but, naturally, without any ammunition in the device and with the device folded down in the barrel. This position of the device D has the advantage of allowing free access to the cylinder. The cylinder can then get loaded from the top, with all the housings being filled except for the one in which the bolt is located. This bolt is in a pending position as in FIG. 11. To complete the loading, it is enough to make the cylinder rotate by one-sixth of a turn. The bolt comes into contact with one of the rounds of ammunition as in FIG. 9 and leaves the possibility of introducing a sixth round of ammunition into the housing that it had occupied before the rotation of the cylinder.

Figure 7:
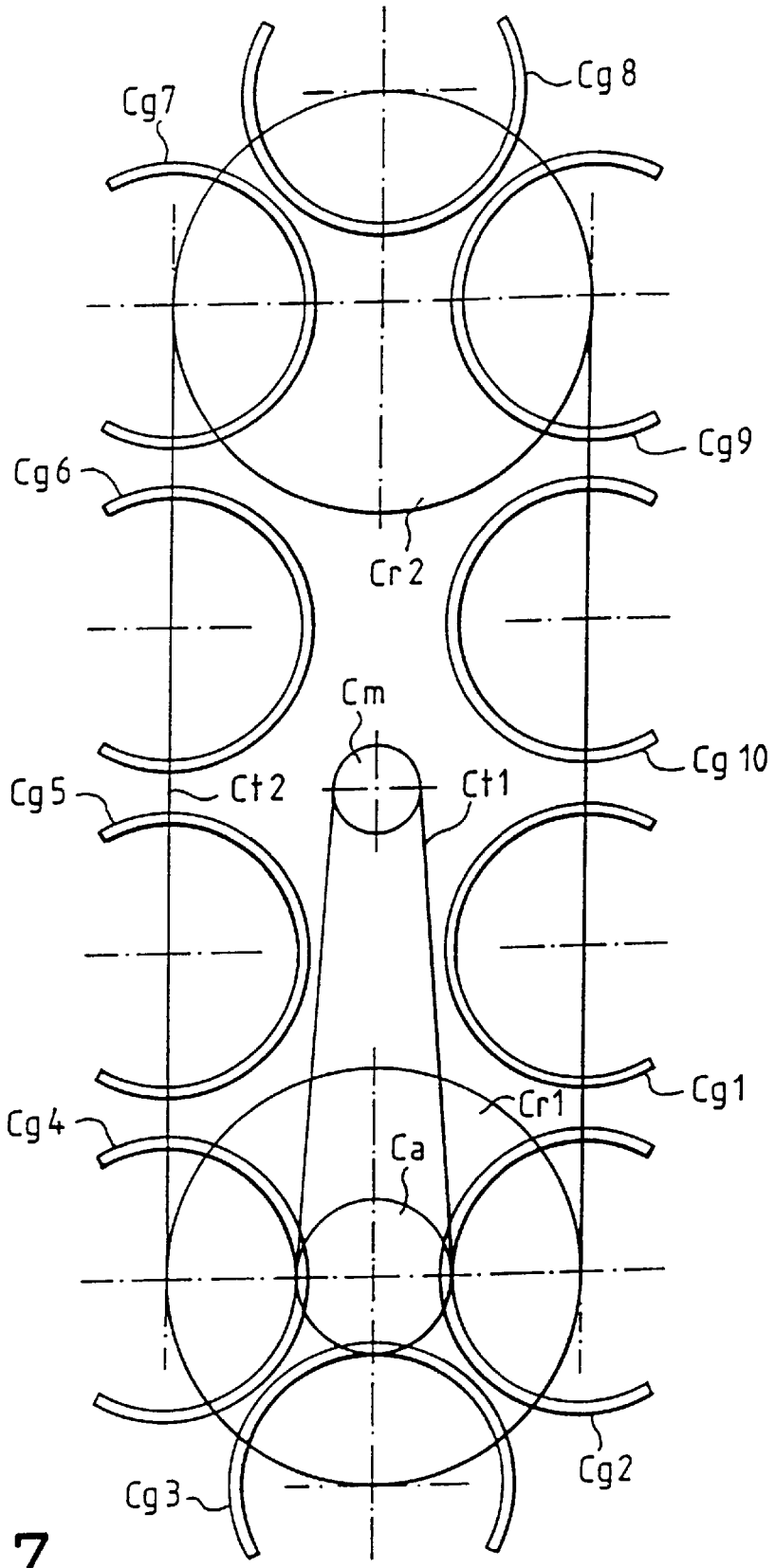
FIG. 7 is a partial schematic view of the mortar of FIG. 6, FIGS. 10 and 11 are partial schematic views of mortars according to FIGS. 4 and 6.

With respect to the loader C of FIGS. 6 and 7, its loading is done as in the case of the cylinder, namely through the top with the double-parallelogram device D placed in the extension of the barrel of the mortar.

The present invention is not limited to the examples described. It can be applied especially to a case where the ammunition magazine may be slightly moved away from the body of the mortar in order to release the bolt and therefore enable the full loading without rotation of the magazine for the introduction of the last round of ammunition. The magazine may be also totally detachable.

The magazine may also have a containing capacity and/or shape that is or are different from those of the magazines described here above.

The invention can be applied to the loading of both smooth mortars and rifled mortars.

What is claimed is:

1. A system for loading of a muzzle-loading mortar having, firstly, a barrel with an interior and a muzzle and, secondly, a bottom part, the system comprising an ammunition magazine provided with rounds of ammunition and transfer means, the magazine being attached to the mortar at the bottom part, having a relative position that is stationary with respect to the barrel, and being provided with a driving device to convey the rounds of ammunition one by one to a predetermined location and the transfer means being mounted on the barrel of the mortar to transfer the rounds of ammunition one by one from the bottom part of the mortar to the interior of the barrel of the mortar, the transfer means comprising hooking means to take the rounds of ammunition one by one from the magazine at the predetermined location.

2. A system for loading of a muzzle-loading mortar having, firstly, a barrel with an interior and a muzzle and, secondly, a bottom part, the system comprising an ammunition magazine provided with rounds of ammunition and transfer means, the magazine being attached to the mortar at the bottom part and being provided with a driving device to convey the rounds of ammunition one by one to a predetermined location and the transfer means being mounted on the barrel of the mortar to transfer the rounds of ammunition one by one from the bottom part of the mortar to the interior of the barrel of the mortar, the transfer means comprising hooking means to take the rounds of ammunition one by one from the magazine at the predetermined location, wherein the transfer means comprises a support that is mobile in a motion of translation parallel to the barrel and wherein the hooking means comprises a mobile part fixedly joined to the support, this mobile part being mobile between two positions, a pending position and a locking position, and this mobile part being tilted into the locking position by the round of ammunition when the round of ammunition arrives at the predetermined location.

3. A system for loading of a muzzle-loading mortar having, firstly, a barrel with an interior and a muzzle and, secondly, a bottom part, the system comprising an ammunition magazine provided with rounds of ammunition and transfer means, the magazine being attached to the mortar at the bottom part and being provided with a driving device to convey the rounds of ammunition one by one to a predetermined location and the transfer means being mounted on the barrel of the mortar to transfer the rounds of ammunition one by one from the bottom part of the mortar to the interior of the barrel of the mortar, the transfer means comprising hooking means to take the rounds of ammunition one by one from the magazine at the predetermined location, wherein the magazine is a cylinder with a driving shaft and wherein the driving device comprises a motor coupled to the shaft to drive the cylinder rotationally.

4. A system for loading of a muzzle-loading mortar having, firstly, a barrel with an interior and a muzzle and, secondly, a bottom part, the system comprising an ammunition magazine provided with rounds of ammunition and transfer means, the magazine being attached to the mortar at the bottom part and being provided with a driving device to convey the rounds of ammunition one by one to a predetermined location and the transfer means being mounted on the barrel of the mortar to transfer the rounds of ammunition one by one from the bottom part of the mortar to the interior of the barrel of the mortar, the transfer means comprising hooking means to take the rounds of ammunition one by one from the magazine at the predetermined location, wherein the magazine is a loader with housings within the magazine to receive rounds of ammunition and wherein the driving device comprises a motor to shift the housings in the loader.

* * * * *